United States Patent [19]

Tanaka

[11] 4,351,520

[45] Sep. 28, 1982

[54] STACKER APPARATUS FOR A CARD COUNTING MACHINE

[75] Inventor: Shigeru Tanaka, Matsudo, Japan

[73] Assignee: Musashi Co., Ltd., Tokyo, Japan

[21] Appl. No.: 231,572

[22] Filed: Feb. 3, 1981

[30] Foreign Application Priority Data

Feb. 19, 1980 [JP] Japan ..... 55/19194

[51] Int. Cl.[3] ..... B65H 29/40

[52] U.S. Cl. ..... 271/315; 271/178; 271/187

[58] Field of Search ..... 271/275, 277, 315, 187, 271/178

[56] References Cited

U.S. PATENT DOCUMENTS 3,912,255 10/1975 McInerny ..... 271/315

4,275,874 6/1981 Di Blasio ..... 271/315 X

*Primary Examiner*—Richard A. Schacher

*Attorney, Agent, or Firm*—Wenderoth, Lind & Ponack

[57] ABSTRACT

A stacker apparatus for a card counting machine including a rotary drum supported for rotation in a predetermined direction and a plurality of "L" shaped arms provided in equispaced relationship around a cylindrical surface of the rotary drum is disclosed. According to this invention, each arm has a root portion extending radially outwardly from the cylindrical surface, a first portion extending from the radially outward end of the root portion in a direction substantially opposite to the predetermined direction, and a second flexible portion extending from the radially outward end of the root portion toward the first portion of the preceding arm into soft contact with the preceding arm.

4 Claims, 2 Drawing Figures

STACKER APPARATUS FOR A CARD COUNTING MACHINE

BACKGROUND OF THE INVENTION

This invention relates generally to a card counting machine and, more particularly, to a stacker apparatus for neatly stacking pieces of sheet material such as paper money, which pieces have been counted by a counting mechanism in the counting machine.

In a card counting machine, heretofore, as shown in FIG. 1, a pair of rotary drums 2 (only one is illustrated) disposed in axial alignment with each other are adapted to receive sheet by sheet the paper money transferred from a not shown counting mechanism through a passage 1 and a guide chute 6. In the cylindrical circumference of each rotary drum 2, a plurality of "L" shaped arms 3 are provided in equispaced relationship. The free end of each arm 3 extends in a direction opposite to the rotational direction (shown by arrow 4) of the drums 2 so that a receiving space or pocket 5 is provided between the free ends of the adjacent arms 3. An opening 6*a* is provided in the shoot 6 to prevent interference of the chute with the arms' rotation. In a stacker apparatus with such rotary drums 2, each piece of paper money sliding down the chute 6 is received in the pocket 5 formed between the preceeding and following arms 3 and rotated with the associated pocket 5 in the clockwise direction by the rotation of the rotary drums 2. When the preceding and following arms 3 pass through an opening 7*a* provided in an accumulating platform 7, the leading end of the paper money positioned radially inwardly of the associated pocket 5 between the preceeding and following arms 3 will engage a portion of the accumulating platform 7, thereby to cause the paper money to be pushed toward a pivotable plate 8 by the free end of the following arm 3. Thus, the paper money can be accumulated sheet by sheet on the accumulating platform 7.

However, in such a stacker apparatus, since there is a relatively large gap 5*a* between the adjacent arms 3, when the paper money is forced into the pocket 5, its leading end will easily pass through the gap 5*a* and then strike against the root portion 3*a* of the preceding arm 3. This not only causes the paper money to jump in the direction opposite to which it was being transported and out of the pocket 5, but also causes the jumping paper money to come into collision with the following paper money.

It is therefore a principal object of this invention to provide a stacker apparatus which can remove the above-mentioned disadvantages of the prior art stacker apparatus.

SUMMARY OF THE INVENTION

In brief, a stacker apparatus according to this invention comprises a rotary drum having a plurality of "L" shaped arms provided in the cylindrical circumference thereof, each arm having an elastic gap closing portion extending toward the preceding arm until it softly contacts the inner surface thereof, thereby to close the gap between the adjacent arms. This gap closing portion extends from the curved part of the "L" shaped arm, which is the most convenient part for manufacturing the arm and for holding paper money between the inner surface of the preceding arm and the gap closing portion of the following arm.

BRIEF DESCRIPTION OF THE DRAWINGS

This invention will become more readily apparent from the following detailed description of the preferred embodiments thereof shown, by way of example only, in the accompanying drawings, wherein.

DETAILED DESCRIPTION OF THE PREFERRED EMBODIMENTS

Figure 1:
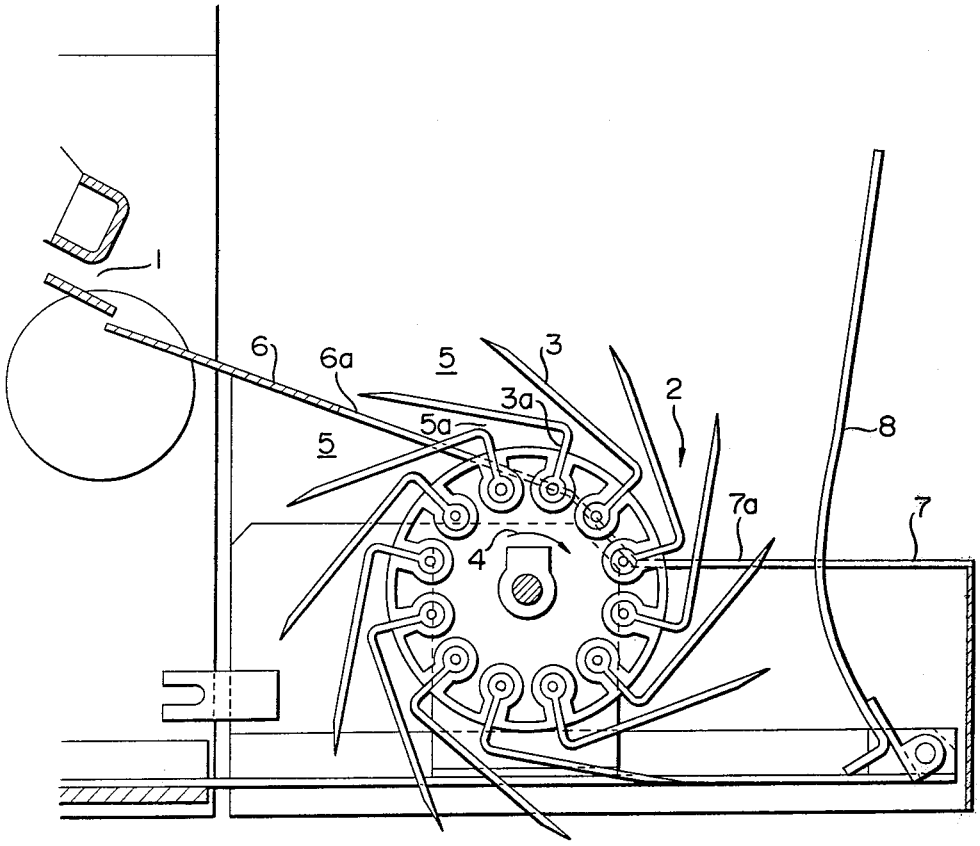
FIG. 1 is a side elevational view of the prior art stacker apparatus.
Figure 2:
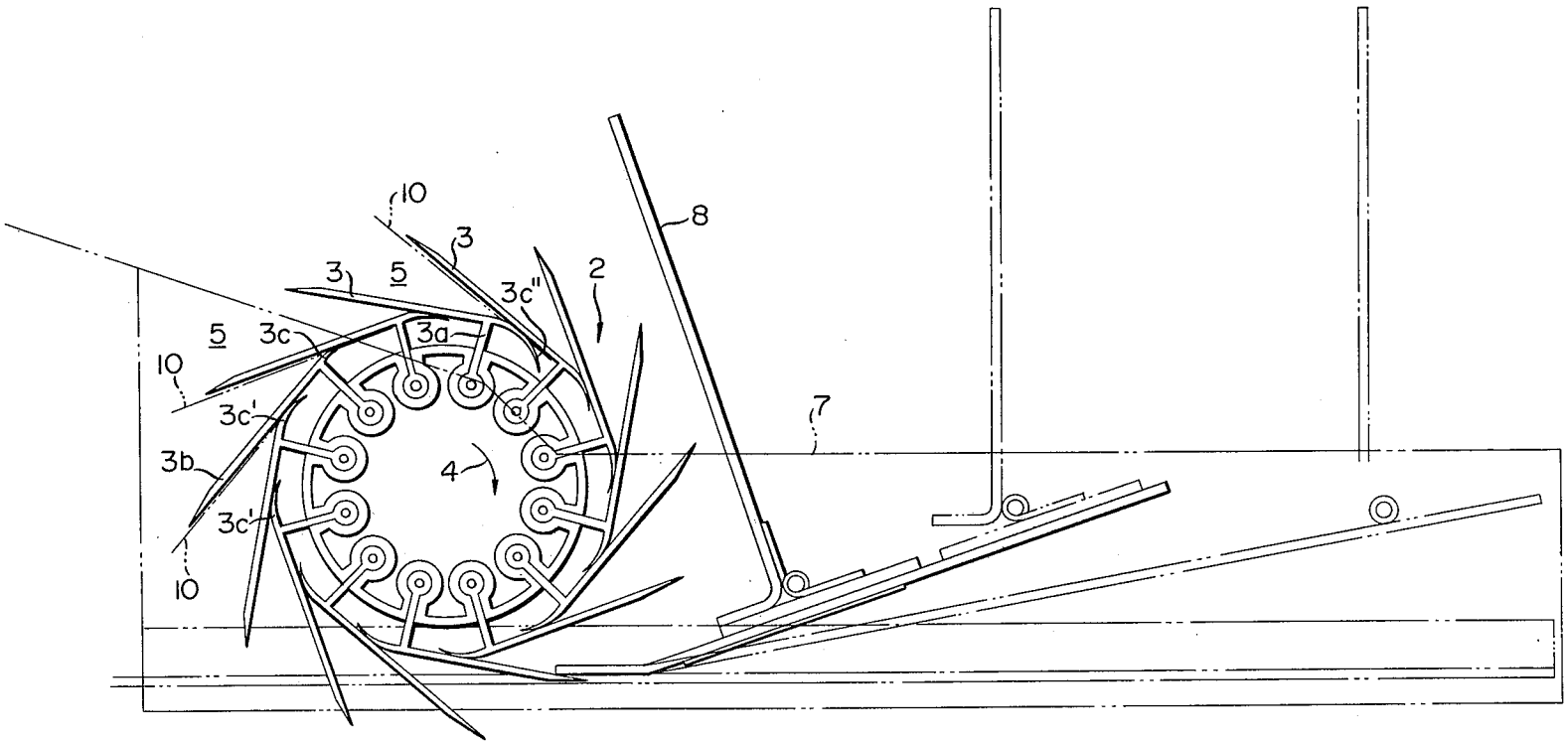
FIG. 2 is a side elevational view showing embodiments of the stacker apparatus according to this invention.

Referring to FIG. 2, there are shown preferred embodiments of this invention, wherein various parts similar or corresponding to those of the prior art stacker apparatus shown in FIG. 1 are indicated by the same numerals. With respect to these parts, further descriptions thereof have been omitted for the sake of simplification.

In FIG. 2, according to this invention, each "L" shaped arm 3 comprises a root portion 3*a* extending radially outwardly from the cylindrical surface of a rotary drum 2 supported for rotation in the direction shown by arrow 4, a first portion 3*b* extending from the free end of the root portion 3*a* in a direction substantially opposite to the rotation direction of the rotary drum 2 so as to form a curved part between the root and first portions 3*a* and 3*b*, and a second flexible portion 3*c* made of any suitable plastic and extending from this curved part toward the preceding arm until it softly contacts the inner surface thereof. At least part of the second portion 3*c* near the curved part between the root and first portions 3*a* and 3*b* extends parallel to the first portion 3*b*, and the free end of the second portion 3*c* is bent radially inwardly. The second portion 3*c*, acting as means for closing a gap 5*a* (FIG. 1) formed between the preceeding and following arms 3, may be an integral part of the first portion 3*b* or may be formed by a separate member, which can be attached to the first portion by suitable means such as bonding. Although the second portion 3*c* is relatively short, it may extend toward the root portion 3*a* of the preceding arm as shown at 3*c*'. Alternatively, the second portion may be further elongated as shown at 3*c*''. It is essential that every arm on the rotary drum 2 has a second portion 3*c*, 3*c*' or 3*c*''.

As described above, according to this invention each arm 3 is provided with the second portion softly contacting the inner surface of the preceding arm so that the leading end of the paper money (shown by the dotted line) sent into the pocket 5 between the adjacent arms can be held by the flexible second portion 3*c*, 3*c*' or 3*c*''. Therefore, there is no fear that the leading end of the paper money 10 will jump out of the pocket 5 by striking against the root portion 3*a* of the preceeding arm 3. Also, this prevents the following paper money from coming into collision with the preceding paper money. Furthermore, it is to be noted that since the second portion is set to the curved part of the arm so as to allow at least its part attached to the curved part to extend parallel to the first portion, the leading end of the paper money sent into the pocket 5 can be rigidly and smoothly held by the second portion. Also, the manufacture of the arms is quite easy.

What I claim is:

1. A stacker apparatus for a card counting machine comprising a rotary drum having a cylindrical outer surface supported for rotation in a predetermined direction, and a plurality of substantially "L" shaped arms provided in equispaced relationship around said cylindrical surface of said rotary drum, each of said arms having a root portion extending radially outwardly from said cylindrical surface, a first portion extending from the radially outward end of said root portion in a direction substantially opposite to said predetermined direction, and a second flexible portion extending from said radially outward end of said root portion toward said first portion of the preceding arm into soft contact with said preceding arm.

2. A stacker apparatus according to claim 1, wherein at least part of said second portion adjacent said radially outward end of said root portion extends parallel to said first portion.

3. A stacker apparatus according to claim 1, wherein said root and said first and second portions of each of said arms are all formed in one piece.

4. A stacker apparatus according to claim 2, wherein said second portion of each of said arms comprises a free end part bent radially inwardly in contact with said preceding arm.

* * * * *